United States Patent [19]

Douri et al.

[11] 3,973,312

[45] Aug. 10, 1976

[54] SLIDER FITTING AND END STOP APPLYING MACHINE

[75] Inventors: Hisashi Douri, Kurobe; Tatsuo Oosaki, Uozu, both of Japan

[73] Assignee: Yoshida Kogyo Kabushiki Kaisha, Japan

[22] Filed: July 11, 1975

[21] Appl. No.: 595,233

[30] Foreign Application Priority Data

July 18, 1974 Japan ..... 49-82897

[52] U.S. Cl. ..... 29/207.5 SL; 74/527

[51] Int. Cl.[2] ..... B23P 19/04

[58] Field of Search ..... 29/207.5 R, 207.5 SL, 29/207.5 ST; 74/527

[56] References Cited

UNITED STATES PATENTS

| | | | |
|---|---|---|---|
| 3,792,521 | 2/1974 | Kawakami | 29/207.5 SL |
| 3,812,571 | 5/1974 | Dori | 29/207.5 SL |
| 3,844,014 | 10/1974 | Takahashi et al. | 29/207.5 SL |

*Primary Examiner*—Henry T. Klinksiek

*Attorney, Agent, or Firm*—Bucknam and Archer

[57] ABSTRACT

There is disclosed a slider fitting and end stop applying machine wherein a combination unit includes an end stop anvil mounted on an arm and a slider jig supported by a support member. The arm and the support member are mounted for pivotal movement about respective axes which are spaced apart laterally from one another. The arm and the support member are operatively interlocked in crossing relation, so that the anvil and the jig move automatically toward and away from each other during the travel between the slider fitting station and the end stop applying station. The jig is provided with means for automatically releasing the slider from the jig when the combination unit reaches the end stop applying station.

5 Claims, 3 Drawing Figures

SLIDER FITTING AND END STOP APPLYING MACHINE

BACKGROUND OF THE INVENTION

This invention relates to a machine for fitting a slider on a pair of slide fastener stringers attached to a garment, such as a pair of trousers, and for applying an end stop to the interlocked fastener stringers subsequently but in immediate succession.

The operation of fitting the slider is closely associated with that of applying the end stop to the bottom end portion of the stringers which have been interlocked by the slider. As well known in the art, the slider is first fitted on the stringers attached to the garment and then the bottom end stop is applied to the interlocked stringers. However, it was difficult to carry out these two different operations within very limited working spaces around the end stop applying machine. The conventional practice was therefore to thread a pair of fastener stringers through a slider supported on the jig of a slider holding machine and thereafter cautiously hand-carry the interlocked stringers onto the anvil of an end stop applying machine located separately wherein a staple-like end stop is applied to a predetermined position of the interlocked fastener stringers. This procedure was not only time-consuming but often involved misplaced end stops on the stringers, so that the finished fastener product was defective in many cases. The hand-carrying relay of the fastener from one place to another was more tedious and skill-requisite particularly where the stringers to be worked upon had been previously attached to garment strips or the like.

Attempts have heretofore been made to eliminate the above-noted difficulties. One such attempt was to propose a combined slider fitting and end stop applying machine wherein a slider jig and an end stop anvil are movable together between a first or slider fitting station where the slide fastener stringers are threaded through a jig-supported slider and a second or end stop applying station where an end stop is secured to the stringers at a desired position. Although this proposal has substantially eliminated the prior art drawbacks, another difficulty with the machine arose; that is, since the jig and anvil members are located adjacent each other on the same block and have their top ends lying substantially on the same level during their movement between the first and second stations, the slider fitting operation was interfered by the adjacent anvil and failed to be effected smoothly. Another prior art attempt was to provide a machine wherein an anvil supporting arm is pivotable with a slider jig slidable mounted on a side of the arm. According to the latter proposal, the arm is pivotable between the slider fitting position where the slider jig is slidably raised along the arm beyond the anvil to enable the slider fitting operation to be effected unobstructedly, and the end stop applying position where the slider jig is slidably lowered to a predetermined point so as to facilitate the end stop applying operation. However, with this arrangement, the overall operation was rather troublesome because the slider jig must be manually moved upwardly and downwardly each time one cycle of the operation is effected. Furthermore, this proposal was disadvantageous in that the garment having the stringers with the end stop mounted thereon can not be removed from the end stop applying position but can be taken away only from the slider assembling position, since the slider can not be released from the jig until the latter has been returned to the slider assembling position where the next cycle of the operation commences.

SUMMARY OF THE INVENTION

It is therefore the primary object of the invention to provide an improved slider fitting and end stop applying machine which obviates the above-noted prior art difficulties.

Another object of the invention is to provide a machine of the type described wherein a slider jig and an end stop anvil move automatically toward and away from each other during the travel between the slider assembling station and the end stop attaching station in order to carry out the successive slider and end stop attaching operations in a simple and speedy manner.

A still another object of the invention is the provision of a machine which enables the slider jig to release the slider automatically therefrom when the jig is located at the end stop applying station.

These and other objects and advantages of this invention will become apparent in the following description when read in conjunction with the accompanying drawings which illustrate by way of example a preferred embodiment and in which like reference characters or numerals refer to like or corresponding parts throughout the views.

DESCRIPTION OF THE PREFERRED EMBODIMENT

Figure 1:
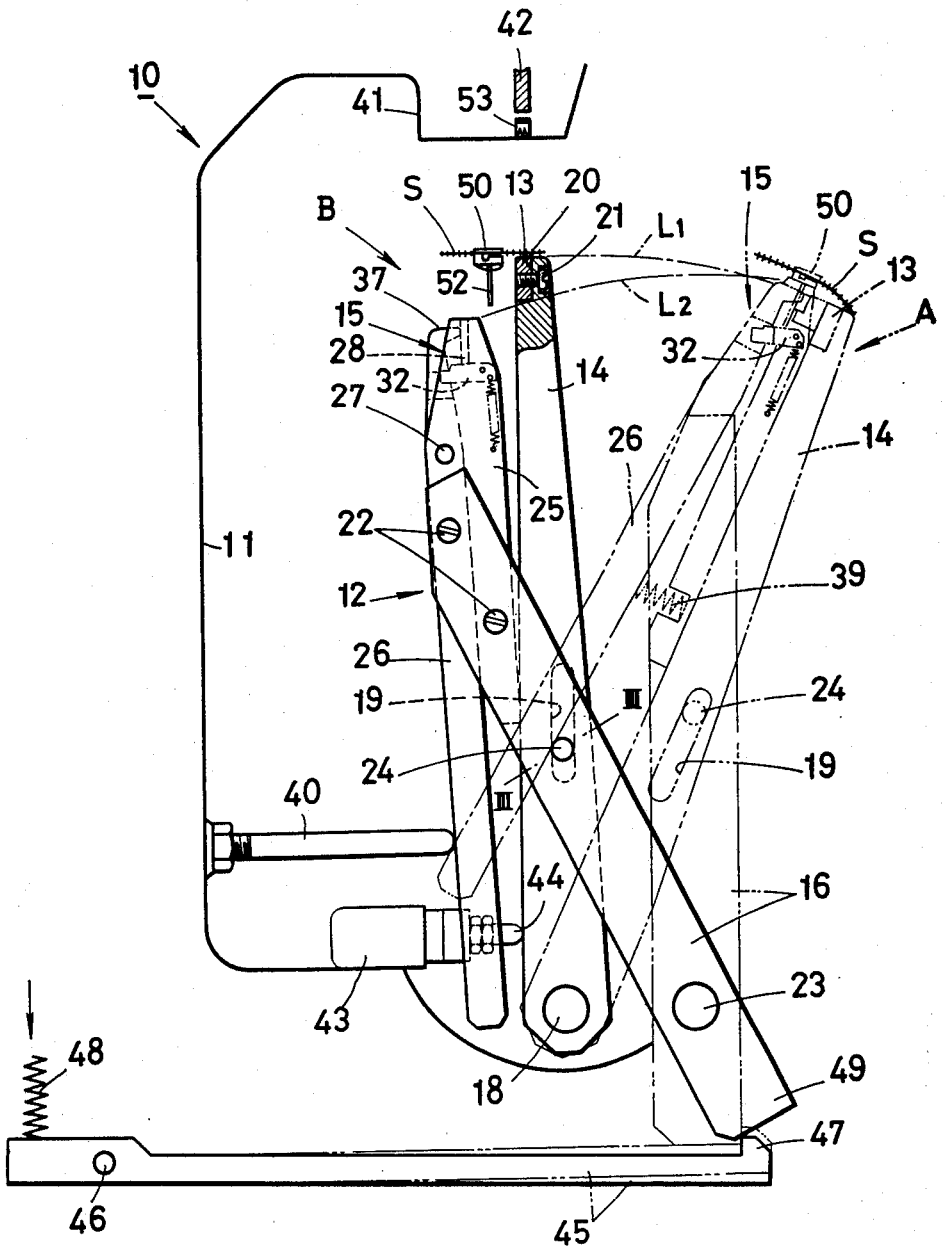
FIG. 1 is a side elevational view, with parts broken away, of a machine embodying the concepts of the present invention, in which the solid lines indicate an end stop applying station and the imaginary lines a slider fitting station.
Figure 3:
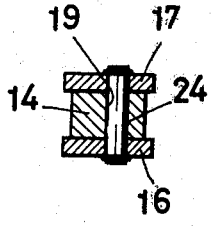
FIG. 3 is a cross-sectional view taken along lines III—III of FIG. 1.

Referring to the drawings and FIG. 1 particularly, there is shown a slider fitting and end stop applying machine generally designated 10 which comprises a machine frame 11 and a combination unit 12 including an anvil 13 mounted on the top end of an arm 14 and a slider holding jig 15 supported by a pair of spaced, elongated supports 16 and 17 (FIG. 3). The arm 14 is mounted for pivotal movement about a first large-diameter pin 18 which is in turn fixedly connected to the machine frame 11. Formed substantially intermediate the ends of the arm 14 is an elongate slot 19 extending along its length. The anvil 13 is received in a cutaway recess 20 formed at the top end of the arm 14 and is secured to the latter by means of a screw 21 which is threaded through the arm 14 and the anvil 13. As is conventional in the art, there are provided indents or recesses (not shown) of a suitable shape in the top surface of the anvil 13 for guiding and bending the legs of a staple-like end stop when the latter is applied to a predetermined position of the interlocked fastener stringers. The jig 15 is interposed between and firmly secured to the upper ends of the spaced supports 16 and 17 by means of screws 22, which supports are pivotally mounted for movement about a second large-diameter pin 23 which is in turn fixedly connected to the machine frame 11. It will be seen that the second pin 23 is laterally spaced apart from the first pin 18 for the reasons described later. The arm 14 and the supports 16, 17 are arranged in crossing relation to, as viewed in side elevation of the machine, and interlocked operatively with each other by means of a small diameter pin 24 fixed to the supports 16 and 17 and disposed slidably within the slot 19 in the arm 14 that is sandwiched between the spaced supports 16 and 17 (see FIG. 3). It will therefore be appreciated that when the arm 14 and the supports 16, 17 are pivoted in cooperative relation about the first pin 18 and the second pin 23, respectively, from a first or slider fitting station A shown in the imaginary lines to a second or end stop applying station B shown in the solid lines, the anvil 13 and the jig 15 follow an arcuate paths $L_1$ and $L_2$, respectively, thereby producing a relative movement between the tops of the anvil 13 and the jig 15.

Figure 2:
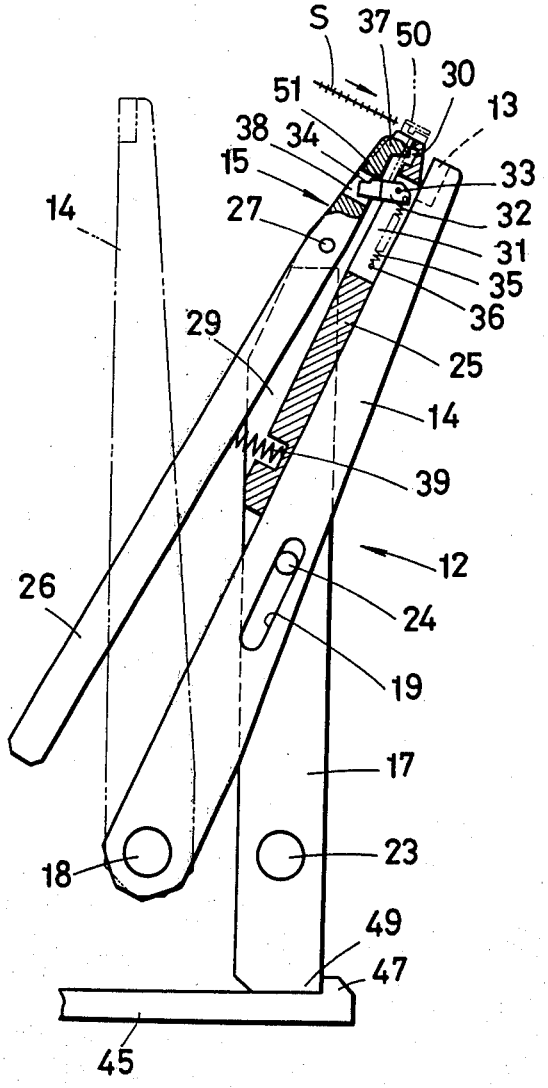
FIG. 2 is a fragmentary side elevational view of the machine with parts cutaway, showing the slider fitting station.

Referring now to FIG. 2, the jig 15 on which a slider is supported broadly comprises a jig body 25 and a level 26 connected pivotally to the body 25 by a pivot pin 27 fixed to the latter. The jig body 25 is provided at its upper portion with a slit 28 for receiving the pull tab of the slider. Reference numeral 29 denotes a vertically extending groove formed in the jig body 25 for receiving the pin-supported lever 26. Formed also in the jig body 25 are a cavity 30 adjacent and communicating with the pull tab receiving slit 28 and an aperture 31 in which a stopper 32 is pivotally supported by a pivot pin 33. The stopper 32 is provided at one end with a stepped portion 34 and is normally biased clockwise as viewed in FIG. 2 by a tension spring 35 which is connected between the other end of the stopper 32 and a pin 36 fixed to the jig body 25. The lever 26 is provided at its top end with a locking prong 37 adapted for insertion into the cavity 30. Designated at 38 is a slit formed in the lever 26 for receiving therein the stepped portion 34 of the stopper 32. A compression spring 39 is disposed between the jig body 25 and the lever 26 to normally bias the lever 26 clockwise as viewed in FIG. 2, or in a direction to move the locking prong 37 into the cavity 30 through the pull tab receiving slit 28.

As shown in FIG. 1, a rod 40 is fixedly connected to a lower portion of the machine frame 11 and extends horizontally so as to engage and rotate the lever 26 counter-clockwise about the pivot pin 27 to hold the locking prong 37 away from the cavity 30 so that the slider may be released from the pull tab receiving slit 28, when the combination unit 12 is at the end stop applying station B.

The machine frame 11 is provided at its upper portion with a head 41 in which a vertically reciprocable punch 42 is arranged in registration with the anvil 13 when the latter is held in the end stop applying station B. The reciprocable punch 42 is driven to move downwardly and upwardly by means of a suitable transmission mechanism (not shown), such as for example an eccentric crank mechanism or a lever crank mechanism, whereby the power from a motor (not shown) is translated into a reciprocating motion. Designated by reference numeral 43 is a limit switch having a feeler 44 adapted to engage the arm 14 when the latter has come to the end stop applying station B in order to connect a clutch (not shown) interposed between the motor and the transmission mechanism, thereby allowing the punch 42 to move downwardly. Disposed beneath the combination unit 12 is a horizontal lever 45 supported for pivotal movement about an axis 46 and having a pawl 47 at one end. A compression spring 48 engages the other end of the lever 45 to normally urge the lever 45 counter-clockwise, so that the pawl 47 engages the bottom edges 49 of the supports 16, 17 to hold the unit 12 in the slider fitting station A, as better seen in FIG. 2.

The operation of the machine will now be reviewed with reference to FIG. 1. The anvil 13 mounted on the arm 14 and the jig 15 supported by the supports 16 and 17 are brought together up to the slider fitting station A where a slider 50 is attached to a pair of fastener stringers S. During this movement, the top of the anvil 13 is pivoted about the first pin 18 to pass along the arcuate path $L_1$, whereas the top of the jig 15 is pivoted about the laterally located second pin 23, to pass along the arcuate path $L_2$, the relative positions of the anvil 13 and the jig 15 being such that when located at the slider fitting station A the jig 15 has its top disposed substantially flush with or preferably at a level higher than the top of the anvil 13. It will be noted that as soon as the jig 15 reaches the slider fitting station A, the bottom edges 49 of the supports 16 and 17 are engaged automatically by the pawl 47 of the lever 45 that is normally biased counter-clockwise as viewed in FIG. 1, so that the combination unit 12 is held stably in position at the slider fitting station A. At this time, the stepped portion 34 of the stopper 32 engages a marginal edge 51 of the slit 38 to keep the locking prong 37 away from the cavity 30 and the pull tab receiving slit 28 against the bias of the spring 39. To support a slider 50 on the jig 15, its pull tab 52 having an opening (not shown) is inserted into the slit 28 of the jig 15 until the pull tab 52 pushes the stopper 32 out of engagement with the marginal edge 51 against the tension of the spring 35, whereupon the spring-loaded lever 26 rotates clockwise about the pivot pin 27 to enable its locking prong 37 to enter and engage with the cavity 30 through the opening of the pull tab 52, thereby holding the slider 50 stably in place on the jig 15. The fastener stringers S are then threaded through the slider 50 in the direction of the arrow and are interlocked in the well-known manner.

Upon completion of the slider fitting operation at the station A, the anvil 13 and the jig 15 are pivoted to the end stop applying station B about the first pin 18 and the second pin 23, respectively, by disengaging the pawl 47 from the edges 49 of the supports 16, 17 by a suitable means (not shown), such as a foot pedal, connected operatively to and capable of swinging the horizontal lever 45 clockwise against the bias of the spring 48. The relative positions of the anvil 13 and the jig 15 at the end stop applying station B are such that the top of the jig 15 is disposed at a level lower than that of the anvil 13 as seen in FIG. 1. It will be appreciated that as the jig 15 approaches the end stop applying station B, the lever 26 is engaged by the rod 40 which in turn causes the locking prong 37 to move about the pin 27 away from the cavity 30 the pull tab receiving slit 28, thereby automatically releasing the pull tab 52 of the slider 50 from locking engagement with the prong 37. Because the stringers S are held in position on the anvil 13 disposed upwardly of the jig 15, the slider 50 which has already been attached to the stringers S is discharged from the jig 15 with the pull tab 52 dependent from the stringers S, as seen from FIG. 1. Simultaneously with this slider releasing operation, the stepped portion 34 of the spring-biased stopper 32 engages again with the marginal edge 51 of the slit 38 to keep the locking prong 37 back from the pull tab receiving slit 28 preparatory to the loading of a next slider at the slider fitting station A. At the end stop applying station B, the punch 42 is actuated by the signal from the limit switch 43 to move downwardly to press a staple-like end stop 53 into position on the interlocked stringers S adjacent the lowermost elements of the interlocked stringers S in the wellknown manner. The operator can then remove the finished stringers together with the garment optionally from the end stop applying station B or the slider fitting station A.

The outstanding features of the invention reside in the novel concept that the anvil and the slider jig are arranged to move relative to each other when both are shifted pivotally from the slider fitting station to the end stop applying station. This arrangement thus makes it possible to carry out both slider and end stop applying operations with maximum ease and speed without being interfered by the anvil or the slider jig. Another advantage of this arrangement is that the garment fabric to which finished stringers are attached can be removed from the machine with utmost ease because the slider has been previously automatically released from the jig at the end stop applying station.

What is claimed is:

1. A machine for fitting a slider on a pair of slide fastener stringers and for applying an end stop to the interlocked fastener stringers, comprising in combination:

a machine frame;

a reciprocally movable end stop applying punch contained in said machine frame; and a combination unit including an anvil mounted on an arm which is mounted for pivotal movement about a first axis, and a slider holding jig supported by a support member which is mounted for pivotal movement about a second axis spaced apart from said first axis, said arm and said support member being operatively interlocked in crossing relation to each other, the arrangement being such that said anvil and said jig are automatically moved up and down with respect to each other while said combination unit is pivoted between a slider fitting station and an end stop applying station where said end stop applying punch registers with said anvil.

2. A machine as defined in claim 1 wherein said arm is provided with an elongated slot for receiving a pin fixedly connected to said support member, thereby interlocking said arm with said support member.

3. A machine as defined in claim 1 wherein said jig and said anvil are located in relative positions in which the top of said jig is disposed at least flush with or at a level higher than that of said anvil at the slider fitting station and at a level lower than that of said anvil at the end stop applying station.

4. A machine as defined in claim 1 wherein said jig includes means for automatically releasing a slider from said jig when said combination unit reaches the end stop applying station.

5. A machine as defined in claim 4 wherein said means comprises a locking prong pivotably mounted on said jig and normally biased in a direction to engage with a cavity formed in said jig, and a rod member fixed to said machine frame and adapted to engage and rotate said locking prong in a direction to move away from said cavity when said combination unit approaches said end stop applying station.

* * * * *